US010730338B2

(12) United States Patent
Murphy

(10) Patent No.: US 10,730,338 B2
(45) Date of Patent: Aug. 4, 2020

(54) FLUID APPLICATOR REFILL SYSTEM

(71) Applicant: Hayden R Murphy, Grand Junction, CO (US)

(72) Inventor: Hayden R Murphy, Grand Junction, CO (US)

( * ) Notice: Subject to any disclaimer, the term of this patent is extended or adjusted under 35 U.S.C. 154(b) by 0 days.

(21) Appl. No.: 15/963,561

(22) Filed: Apr. 26, 2018

(65) Prior Publication Data

US 2018/0311994 A1 Nov. 1, 2018

Related U.S. Application Data

(60) Provisional application No. 62/490,099, filed on Apr. 26, 2017.

(51) Int. Cl.

| | |
|---|---|
| ***B43K 11/00*** | (2006.01) |
| ***B43K 8/04*** | (2006.01) |
| ***B43K 8/03*** | (2006.01) |
| ***B43L 19/00*** | (2006.01) |

(52) U.S. Cl.

CPC ..... *B43K 11/00* (2013.01); *B43K 8/03* (2013.01); *B43K 8/04* (2013.01); *B43K 11/005* (2013.01); *B43L 19/0018* (2013.01); *B43L 19/0068* (2013.01)

(58) Field of Classification Search

CPC ..... B43K 11/00; B43K 11/0005

See application file for complete search history.

(56) References Cited

U.S. PATENT DOCUMENTS

| | | | | |
|---|---|---|---|---|
| 2,938,499 | A * | 5/1960 | Lindenbaum | B43K 11/00 141/20.5 |
| 4,772,148 | A | 9/1988 | Buschemeyer | |
| 5,290,116 | A | 3/1994 | Chang | |
| 5,454,658 | A | 10/1995 | Kato | |
| 5,518,331 | A * | 5/1996 | Moosmann | B43K 5/08 401/230 |
| 6,632,041 | B1 | 10/2003 | Witz et al. | |
| 6,695,517 | B2 | 2/2004 | Witz et al. | |
| 6,986,620 | B2 * | 1/2006 | Abbas | B43K 5/18 401/188 A |
| 6,989,620 | B2 | 1/2006 | Abbas | |
| 7,086,799 | B1 | 8/2006 | Pappageorge et al. | |
| 7,578,631 | B2 | 8/2009 | Kurita et al. | |
| 8,128,304 | B2 | 3/2012 | Kurita et al. | |
| 2006/0263144 | A1 | 11/2006 | Wang | |
| 2011/0158738 | A1 * | 6/2011 | Bainbridge | B05C 17/00516 401/206 |

(Continued)

FOREIGN PATENT DOCUMENTS

| | | |
|---|---|---|
| CN | 2423122 | 3/2001 |
| CN | 2468744 | 1/2002 |

(Continued)

*Primary Examiner* — J C Jacyna

(74) *Attorney, Agent, or Firm* — Heuton IP Law, LLC

(57) ABSTRACT

The present invention provides devices, systems, and methods for refilling a refillable fluid applicator, such as but not limited to a refillable dry erase marker. The devices, systems, and methods of the present invention advantageously allow the fluid applicator to be refilled quickly, easily, and inexpensively, and provide the benefit of significantly reducing the quantity of solid plastic waste associated with conventional disposable dry erase markers and other fluid applicators.

10 Claims, 8 Drawing Sheets

(56) References Cited

U.S. PATENT DOCUMENTS

| | | | | |
|---|---|---|---|---|
| 2013/0004231 | A1* | 1/2013 | Nakatani | B43K 8/02 401/198 |
| 2013/0078025 | A1 | 3/2013 | Turgernan et al. | |
| 2017/0246901 | A1* | 8/2017 | Nishitani | B43K 11/00 |

FOREIGN PATENT DOCUMENTS

| | | | | |
|---|---|---|---|---|
| CN | 2719593 | | 8/2005 | |
| CN | 101073963 | | 11/2007 | |
| CN | 101716862 | | 6/2010 | |
| CN | 201520117 | | 7/2010 | |
| CN | 202608312 | | 12/2012 | |
| CN | 202685618 | | 1/2013 | |
| CN | 102971157 | | 3/2013 | |
| CN | 202847198 | | 4/2013 | |
| CN | 105730064 | | 7/2016 | |
| CN | 106079967 | | 11/2016 | |
| JP | 2016-078326 | | 5/2016 | |
| WO | WO 94/29125 | * | 12/1994 | B43K 11/00 |

* cited by examiner

FLUID APPLICATOR REFILL SYSTEM

CROSS REFERENCE TO RELATED APPLICATIONS

This application claims priority to U.S. Provisional Patent Application No. 62/490,099, filed Apr. 26, 2017, which is incorporated herein by reference in its entirety.

FIELD OF THE INVENTION

The present disclosure relates to refillable fluid applicating instruments. Specifically, the disclosure relates to systems, devices, and methods for refilling, recharging, and replenishing fluid applicating writing instruments, including but not limited to dry erase markers.

BACKGROUND OF THE INVENTION

One common type of fluid applicating writing device is a dry erase marker. The dry erase marker has traditionally been a disposable instrument, built with inexpensive materials and supplied with a finite volume of ink. These disposable markers have short functional lifetimes due to their limited ink supply, nibs (marker tip, ink applicator) that dry out, and design flaws that limit the functional lifetime of the marker. As a result, it is estimated that schools in the United States alone throw away 70 million dry erase markers, thereby generating more than 1.4 million pounds of plastic waste, each year. To compound this problem, it is difficult or impossible to recycle spent dry erase markers because they are made from a mix of materials, and because the residual ink is often highly flammable.

The quantity of waste generated by disposable dry erase markers has prompted many designs for refillable dry erase markers. Some designs have included markers with removable lids or end caps, which allow a user to refill the marker manually by connecting a separate ink source to the marker and squeezing ink into the body of the marker. Other designs comprise replaceable ink vials or cartridges specifically adapted for use in the marker. These designs, although functional, have various drawbacks, including spilling or leaking ink while performing refilling, difficult or time-consuming refilling processes, and costly ink supplies. Moreover, such designs generate further solid wastes, such as empty ink bottles or spent vials or cartridges.

Dry erase markers are used particularly extensively in academic settings. In such settings, multiple educators, any or all of whom may use dry erase markers extensively, may share a single classroom and therefore a single supply of markers. As a result, the inability to locate a functional marker is a frequent annoyance for many educators. The use of refillable marker designs currently on the market would only moderately improve the situation; educators are unlikely to go to the effort of performing a refill operation or risk an ink spill or leak, especially in the middle of a class or lecture. Thus, most educational institutions still use disposable markers due to their ease of use, relatively cheap cost, and spill-proof design.

There is a thus a need in the art for systems, devices, and methods by which a dry erase marker or other fluid applicating writing instrument can be refilled, recharged, or replenished quickly, easily, and inexpensively. It is further advantageous for such systems, devices, and methods to be substantially spill-proof and leak-proof.

SUMMARY OF THE INVENTION

It is one aspect of the present invention to provide a refillable fluid applicator, comprising a fluid reservoir; a reservoir frame; and an applicator tip, wherein the fluid reservoir comprises one or more flexible films, the one or more flexible films consisting of at least one material that is substantially impermeable to a fluid contained in the fluid reservoir and surrounding and defining a fluid cavity having a variable volume, and wherein the fluid cavity occupies a selected portion of an interior space of the reservoir frame when the variable volume is maximized and flattens when the variable volume is minimized such that one of the following is true: (i) the fluid reservoir of the refillable fluid applicator comprises one flexible film, and two opposing sides of the one flexible film contact, or nearly contact, each other; and (ii) the fluid reservoir of the refillable fluid applicator comprises at least two flexible films, and the at least two flexible films contact, or nearly contact, each other.

In embodiments, the refillable fluid applicator may further comprise a valve disposed between the fluid reservoir and the applicator tip, wherein the fluid reservoir and the applicator tip are in fluid communication when the valve is open and not in fluid communication when the valve is closed. The refillable fluid applicator may further comprise an elastic element separate from the valve, wherein the elastic element is configured to open the valve when pressure is exerted on the applicator tip and to hold the valve closed otherwise, and/or the refillable fluid applicator may further comprise an elastic element integrated with the valve, wherein the elastic element is configured to open the valve when pressure is exerted on the applicator tip and to hold the valve closed otherwise.

In embodiments, the refillable fluid applicator may further comprise a magnetically attractive element, wherein the magnetically attractive element is configured to exert an attractive force on a corresponding magnetically attractive element of a refilling unit to align and securely interconnect the refillable fluid applicator with the refilling unit.

In embodiments, the refillable fluid applicator may further comprise a porous element disposed between the fluid reservoir and the applicator tip.

In embodiments, the refillable fluid applicator may further comprise at least one septum associated with the fluid reservoir, wherein the at least one septum is configured to be penetrated by a fluid communicating element of a refilling unit and allow flow of a fluid from the refilling unit into the fluid reservoir via the fluid communicating element, and to form a substantially fluid-tight seal of the fluid reservoir when not penetrated by the fluid communicating element.

It is another aspect of the present invention to provide a fluid applicator refill system, comprising a refillable fluid applicator, comprising a first interface element, a fluid reservoir, and an applicator tip, wherein fluid in the fluid reservoir has a first pressure; and a refilling unit, comprising a primary fluid reservoir, at least one actuating member, a valve, a second interface element, and at least one fluid communicating element, wherein fluid in the primary fluid reservoir has a second pressure, wherein the second pressure is higher than both an ambient atmospheric pressure and the first pressure, wherein the first and second interface elements are configured to generate an interface force when placed in physical contact with, or close proximity to, each other, wherein the at least one actuating member is configured, when acted upon by the interface force, to open the valve and cause the at least one fluid communicating element to place the fluid reservoir of the refillable fluid applicator and the primary fluid reservoir in fluid communication, and wherein, when the valve is open, fluid contained in the primary fluid reservoir flows out of the primary fluid reservoir, through the valve and the at least one fluid communicating element, and into the fluid reservoir of the refillable fluid applicator.

In embodiments, the refillable fluid applicator may further comprise a valve disposed between the fluid reservoir and the applicator tip, wherein the fluid reservoir and the applicator tip are in fluid communication when the valve is open and not in fluid communication when the valve is closed. The refillable fluid applicator may further comprise an elastic element separate from the valve, wherein the elastic element is configured to open the valve when pressure is exerted on the applicator tip and to hold the valve closed otherwise, and/or the refillable fluid applicator may further comprise an elastic element integrated with the valve, wherein the elastic element is configured to open the valve when pressure is exerted on the applicator tip and to hold the valve closed otherwise.

In embodiments, the first and second interface elements may be magnetically attractive and the interface force may comprise a magnetic force, wherein the magnetic force aligns and securely interconnects the refillable fluid applicator with the refilling unit.

In embodiments, the refillable fluid applicator may further comprise a porous element disposed between the fluid reservoir and the applicator tip.

In embodiments, the refillable fluid applicator may be a writing instrument.

It is another aspect of the present invention to provide a fluid applicator refilling unit, comprising a primary fluid reservoir; at least one actuating member; a valve; an interface element; and at least one fluid communicating element, wherein a pressure of fluid in the primary fluid reservoir is higher than an ambient atmospheric pressure, wherein the interface element is configured to generate an interface force when placed in physical contact with, or close proximity to, a corresponding element of a fluid applicator, wherein the at least one actuating member is configured, when acted upon by the interface force, to open the valve and cause the at least one fluid communicating element to place a fluid reservoir of the fluid applicator and the primary fluid reservoir in fluid communication, wherein, when the valve is open, fluid contained in the primary fluid reservoir flows out of the primary fluid reservoir and through the valve and the at least one fluid communicating element, and wherein the fluid applicator refilling unit is capable of being nested with, or interconnected, attached, affixed, or otherwise placed in close proximity to, at least one other fluid applicator refilling unit.

In embodiments, the fluid applicator refilling unit may comprise a single valve and a single interface element, and may be capable of refilling a single fluid applicator at a time.

In embodiments, the fluid applicator refilling unit may comprise at least two valves and at least two interface elements, and may be capable of refilling at least two fluid applicators at a time. The fluid applicator refilling unit may comprise at least two primary fluid reservoirs, each of the at least two primary fluid reservoirs being associated with a selected one of the at least two valves and a selected one of the at least two interface elements and configured to refill a selected one of the at least two fluid applicators. The at least two fluid applicators may be writing instruments and the fluid may be ink. The ink in one of the at least two primary fluid reservoirs may be of a different color than the ink in a different one of the at least two primary fluid reservoirs.

It is another aspect of the present invention to provide a dry erase marker that can be quickly, easily, and inexpensively refilled, in a substantially spill-proof and leak-proof manner, via a refilling unit. The system comprising the marker and refilling unit allows a user to "dock" the refillable marker to the refilling unit so that the marker can be refilled automatically, alleviating the need for user participation in the refilling process. The marker can remain attached to the refilling unit indefinitely until the next use of the marker. The refilling unit can be placed in close proximity to a whiteboard or other location that allows ease of access. The refilling unit comprises an ink reservoir capable of holding a supply of ink sufficient for several refills, which may be easily and inexpensively replaced when the supply is exhausted.

It is another aspect of the present invention to provide a dry erase marker refilling unit, comprising a collapsible ink reservoir, which allows the marker to be filled on the refilling unit in any orientation. The collapsible reservoir design does not require venting to vacate air from the marker ink chamber, as other refillable marker designs require. The collapsible reservoir is made of one or more flexible materials, including but not limited to rubber, plastic materials, and metallic materials, which constrains the ink in an interior space of the reservoir, and which may be capable of flexing into a more rounded form when the reservoir is substantially full, then flattening, with walls contacting or nearly contacting one another in a center section of the reservoir, as the ink supply is depleted. The material(s) of which the collapsible reservoir is made may, but need not, be provided in the form of one or more films. In some embodiments, the marker may interconnect to the refilling unit magnetically, allowing a user to simply bring a refilling end of the marker into close proximity to a receptacle of the refilling unit such that the marker will automatically align and securely attach itself to the refilling unit, while in other embodiments the force that interconnects the marker to the refilling unit may be as simple as the weight or pressure of the marker in a seat, slot, or other receptacle of the refilling unit. Compared to prior art solutions, the present invention thus substantially decreases the labor required of the user to refill the marker and reduces the risk of spilling or spraying ink onto the user or another surface during the refilling process.

In some embodiments of the present invention, a refilling unit comprises a rigid body, a removable reservoir, a valve configured to selectively allow or disallow the flow of ink, a tube configured to communicate ink between the reservoir and the valve, a spring configured to selectively open or close the valve, a valve actuating feature, a marker receptacle, an ink communicating element configured to communicate ink between the valve and the marker receptacle, a septum piercing tube, and a magnetically attractive element.

In some embodiments of the present invention, a refillable marker comprises a rigid body, at least one septum, a magnetically attractive element, an ink reservoir having a variable volumetric capacity, a fluid marking tip, an element of fluid communication configured to communicate ink between the ink reservoir and the fluid marking tip, and a vent configured to allow air to exit the marker body.

In some embodiments of the present invention, the refilling unit can be mounted on any of a variety of surfaces including but not limited to a whiteboard, a horizontal surface, and a vertical surface, to assist a user in accessing one or more markers associated with the refilling unit.

In a first embodiment of a fluid applicator refill system according to the present invention, a refilling unit capable of refilling multiple fluid applicators in a single refilling unit via multiple applicator seats is provided; the multiple fluid applicators may all be refilled from a single common fluid reservoir of the refilling unit, and/or each fluid applicator may be refilled via a separate dedicated reservoir. In a second embodiment of a fluid applicator refill system according to the present invention, a refilling unit capable of refilling a single fluid applicator via a single applicator seat is provided. Two or more refilling units according to either or both of these first and second embodiments may, but need not, be nested with, or interconnected, attached, affixed, or otherwise placed in close proximity to, one another to allow a user to have a customized variety of fluid applicators in one location.

In some embodiments of the fluid applicator refill system, a refilling unit is configured to refill a writing instrument, including but not limited to a dry erase marker, with ink of a particular color. It may be particularly advantageous for two or more refilling units according to these embodiments to be nested with, or interconnected, attached, affixed, or otherwise placed in close proximity to, one another to allow a user to have a customized variety of writing instrument colors in one location.

BRIEF DESCRIPTION OF THE DRAWINGS

FIGS. 16B and 16C are detailed illustrations of the portion of FIG. 16A inside the dotted circle, showing alternative embodiments of a rounded feature associated with a valve rod.

FIGS. 17B and 17C are detailed illustrations of the portion of FIG. 17A inside the dotted circle, showing alternative embodiments of a rounded feature associated with a valve rod.

To provide further clarity to the Detailed Description provided herein and the associated drawings, the following list of components and associated reference numbers is provided as follows:

| Reference No. | Component |
|---|---|
| 1 | Fluid applicator assembly |
| 2 | Fluid applicator body |
| 3 | Retaining cap |
| 4 | Retaining cap rib |
| 5 | First magnetically attractive element |
| 6 | Septum |
| 7 | Reservoir frame |
| 8 | Fluid reservoir |
| 9 | Shaped union |
| 10 | Fluid-tight seal |
| 11 | Porous element |
| 12 | Applicator tip |
| 13 | Connecting leg |
| 14 | Vent |
| 15 | Fluid cavity |
| 16 | Refilling unit assembly |
| 17 | Refilling unit body |
| 18 | Primary fluid reservoir |
| 19 | Reservoir-to-valve fluid communicating element |
| 20 | Valve |
| 21 | Valve spring |
| 22 | Actuating member |
| 23 | Valve-to-applicator fluid communicating element |
| 24 | Third magnetically attractive element |
| 25 | Fluid |
| 26 | Applicator seat |
| 27 | Retaining cap ring |
| 28 | Fluid reservoir entrance |
| 29 | Mounting surface |
| 30 | Whiteboard |
| 31 | Receptacle of multi-applicator refilling unit |
| 32 | Replaceable fluid reservoir |
| 33 | Applicator tip cap |
| 34 | Second magnetically attractive element |
| 35 | Replaceable refilling unit assembly |
| 36 | Receptacle of single-applicator refilling unit |
| 37 | Replaceable fluid reservoir |
| 38 | Sealing surface |
| 39 | Valve rod |
| 40 | Separate elastic element |
| 41 | Applicator tip seat |
| 42 | Combined applicator tip seat/spring feature |

-continued

| Reference No. | Component |
|---|---|
| 43 | Integrated elastic element |
| 44 | Rubber element |

DETAILED DESCRIPTION OF THE DRAWINGS

Figure 1:
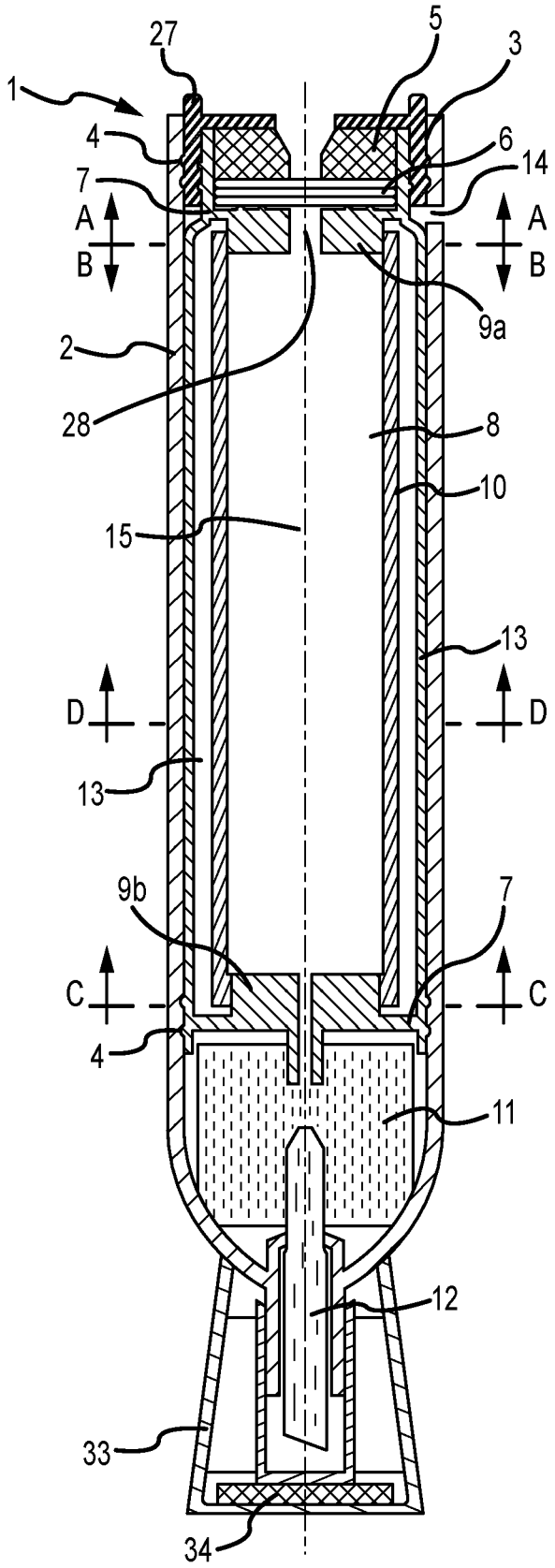
FIG. 1 is a longitudinal cross-sectional view of an embodiment of a refillable fluid applicator according to the present invention, showing a broad side of a collapsible fluid reservoir of the refillable fluid applicator.
Figure 2:
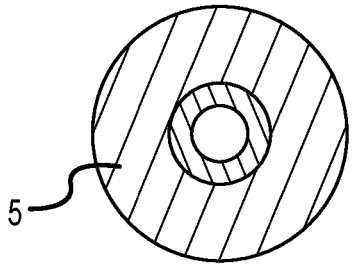
FIG. 2 is a top view of a first magnetically attractive element of the refillable fluid applicator illustrated in FIG. 1.
Figure 3:
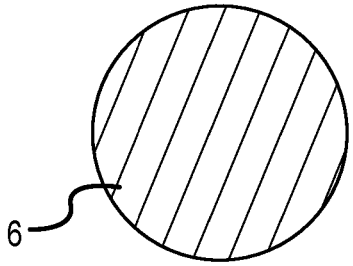
FIG. 3 is a top view of a septum of the refillable fluid applicator illustrated in FIG. 1.
Figure 4:
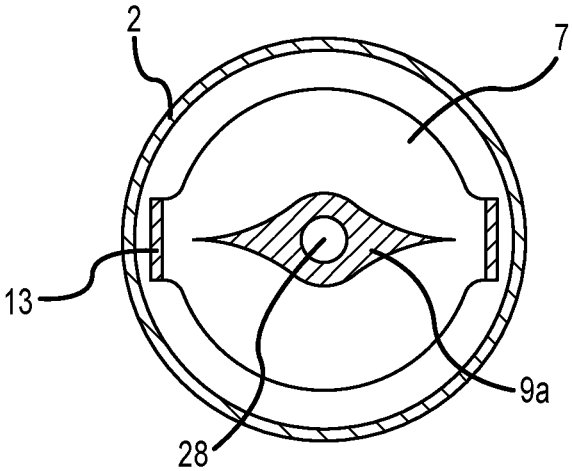
FIG. 4 is a cross-sectional view of the refillable fluid applicator illustrated in FIG. 1, taken at the line marked "A-A."
Figure 5:
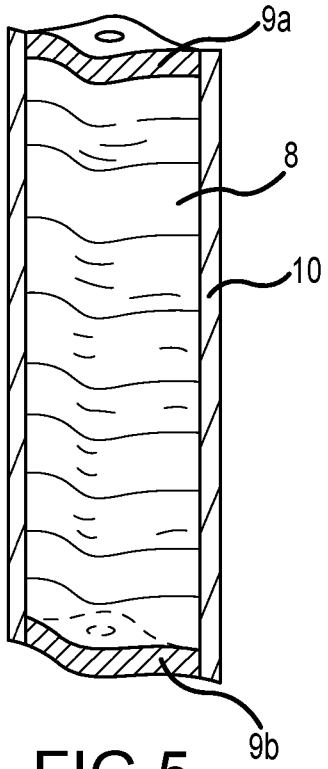
FIG. 5 is a perspective view of the fluid reservoir illustrated in FIG. 1, sectioned between the lines marked "B-B" and "C-C."
Figure 6:
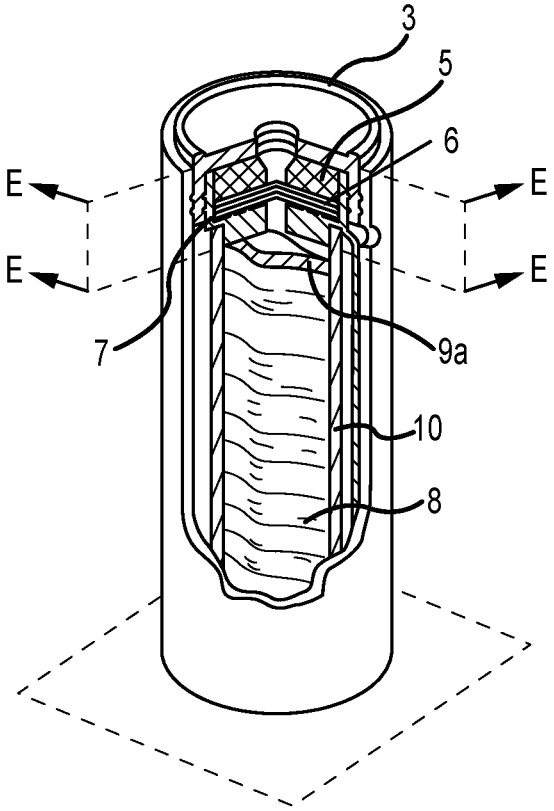
FIG. 6 is a perspective view of the refillable fluid applicator illustrated in FIG. 1, sectioned at the line marked "D-D" and with perpendicular planes marked "E-E," and opened to show the fluid reservoir geometry in a full position.

Referring now to FIGS. 1-6, a fluid applicator assembly 1 for a refillable fluid applicator according to embodiments of the present invention comprises a fluid applicator body 2, an applicator tip cap 33, and a retaining cap 3 held in place in the fluid applicator body 2. Although the fluid applicator body 2 of the embodiment of the refillable fluid applicator illustrated in FIG. 1 is substantially cylindrical, it is to be expressly understood that in embodiments, the fluid applicator body 2 may have any suitable shape or cross-section, including but not limited to an ovular, triangular, or rectangular cross-section, and that such embodiments are within the scope of the invention. The retaining cap 3 holds a first magnetically attractive element 5 (illustrated in top view in FIG. 2) and one or more sealing septa 6 (illustrated in top view in FIG. 3) in place; although the embodiment of the refillable fluid applicator illustrated in FIG. 1 comprises three septa, any number of septa, including one, two, three, or more than three, may be provided to ensure a complete seal of an interior of the fluid applicator assembly 1. The reservoir frame 7 is held in place on the retaining cap 3 and the fluid applicator body 2. Although the retaining cap 3 and reservoir frame 7 of the embodiment of the refillable fluid applicator illustrated in FIG. 1 are held in place by retaining ribs 4, which are illustrated as annular but may take any suitable shape, it is to be expressly understood that in embodiments, the retaining cap 3 and reservoir frame 7 may be held in place by any other suitable means, and that such embodiments are within the scope of the invention. The reservoir frame 7 provides structure and sealing surfaces for a fluid reservoir 8, which is collapsible. Top and bottom sections of the reservoir frame 7 are connected via connecting legs 13. The fluid reservoir 8 comprises one or more, in this case two, flexible films or membranes, which are sealed together to form a fluid-tight seal 10, and are further sealed at each end with sealing surfaces of shaped unions 9*a*, 9*b*. Although the fluid reservoir 8 of the embodiment of the refillable fluid applicator illustrated in FIG. 1 comprises two flexible films, it is to be expressly understood that in embodiments, the fluid reservoir 8 may comprise any number of flexible films equal to or greater than one, and that such embodiments are within the scope of the present invention. Where the fluid reservoir 8 comprises a single flexible film, two opposing sides of the single flexible film may be sealed together, and/or crimped, folded, or hooped together, to form the fluid-tight seal 10. The two or more flexible films or membranes of the fluid reservoir 8 may be made of any suitable material(s) that is/are substantially impermeable to the fluid, including but not limited to a rubber, plastic materials, and/or metallic materials, such that the fluid does not leak or spill out of the fluid reservoir 8 and remains within a fluid cavity 15. The fluid reservoir 8 has a variable volumetric capacity, provided by the two or more flexible films or membranes and the geometry of shaped unions 9*a* and 9*b*. The fluid reservoir 8 is in an approximately fully expanded form when the fluid cavity 15 is at its maximum volume, as illustrated in FIG. 5, and is empty and fully collapsed when the flexible films (or, where there is a single flexible film, opposing sides of the flexible film) contact, or nearly contact, one another in the center section of the reservoir and the volume of the fluid cavity 15 is at its minimum. When the fluid reservoir 8 is filling or emptying fluid, the air within the fluid applicator body 2 is balanced with atmospheric air via vent 14. The fluid contents of the fluid reservoir are issued through the bottom section of the reservoir frame 7 into porous element 11, which communicates fluid to the applicator tip 12. The applicator tip cap 33 may, but need not, comprise a second magnetically attractive element 34.

Figure 7:
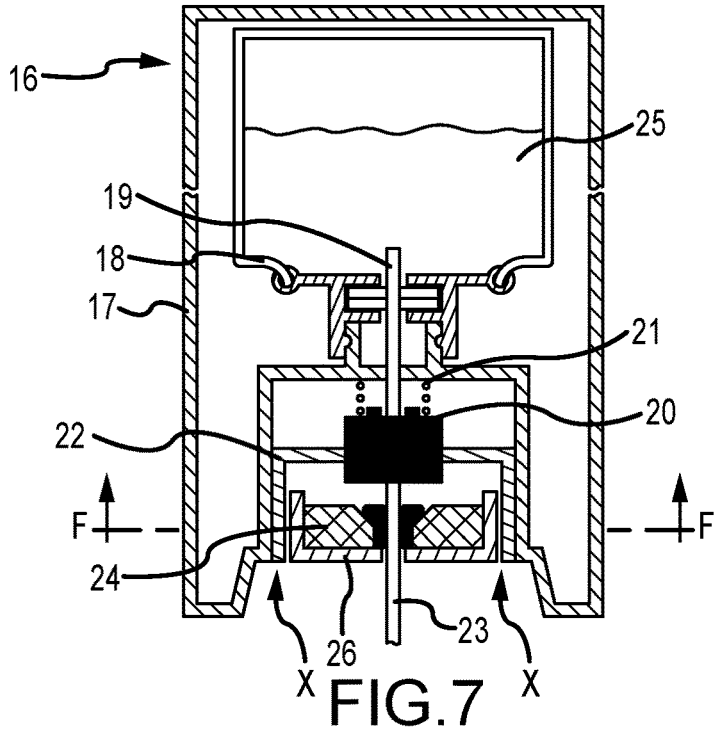
FIG. 7 is a longitudinal cross-sectional view of an embodiment of a refilling unit according to the present invention.
Figure 8:
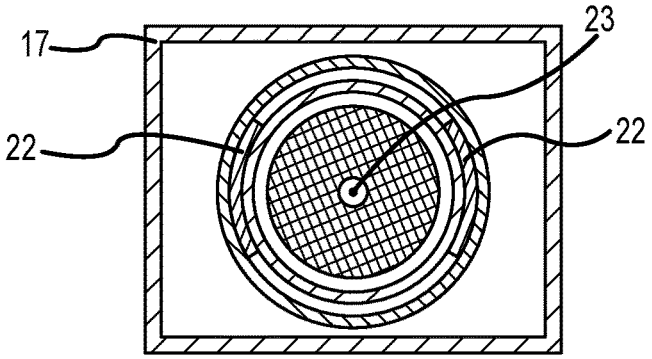
FIG. 8 is a cross-sectional view of the refilling unit illustrated in FIG. 7, taken at the line marked "F-F."
Figure 9:
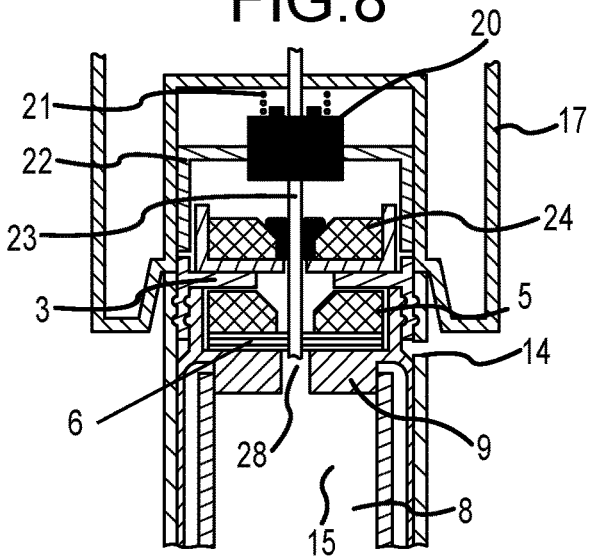
FIG. 9 is a longitudinal cross-sectional view of the refillable fluid applicator illustrated in FIG. 1 attached to the refilling unit illustrated in FIG. 7.

Referring now to FIGS. 7-9, a refilling unit assembly 16 according to embodiments of the present invention comprises a refilling unit body 17, a primary fluid reservoir 18, fluid 25, a reservoir-to-valve fluid communicating element 19, a valve 20, a valve spring 21, one or more actuating members 22, a valve-to-applicator fluid communicating element 23, a third magnetically attractive element 24, and an applicator seat 26. The reservoir-to-valve communicating element 19 transports fluid 25 from the primary fluid reservoir 18 to the valve 20. When a refillable fluid applicator assembly 1 according to the present invention, such as that illustrated in FIGS. 1-6, is brought near the applicator seat 26, magnetic forces between the first magnetically attractive element 5 and the third magnetically attractive element 24, illustrated by the arrows labeled "X" in FIG. 7, automatically align the refillable fluid applicator assembly 1 with the applicator seat 26 and causes actuating member(s) 22 to open the valve 20. When the valve 20 is open, fluid 25 can travel through the valve 20 into the valve-to-applicator fluid communicating element 23, which in turn communicates the fluid through the one or more septa 6 of the refillable fluid applicator assembly 1, through the fluid reservoir entrance 28, and into the fluid cavity 15.

It is to be expressly understood that embodiments of the present invention need not comprise magnetically attractively elements 5, 24, and that the refillable fluid applicator and refilling unit of the present invention may be configured to interconnect by any suitable force including but not limited to a magnetic force. By way of non-limiting example, the force that causes the refillable fluid applicator assembly 1 to align with the applicator seat 26, and/or that causes actuating member(s) 22 to open the valve 20, may be as simple as the weight or pressure of the refillable fluid applicator assembly 1 in the refillable applicator seat 26, or another slot, receptacle, etc., of the refilling unit assembly 16. The aligning and actuating force(s) can thus comprise, by way of non-limiting example, a contact force or an electrical force in addition to or instead of a magnetic force.

It is to be further expressly understood that the applicator seat 26 of embodiments of the present invention may take any suitable form that securely holds the fluid applicator body 2 in place on the refilling unit body 17. By way of non-limiting example, the applicator seat 26 may be a magnetically attractive element that exerts a magnetic force on a corresponding magnetically attractive element of the fluid applicator assembly 1; a female connector that securely receives a male connector disposed on the fluid applicator body 2; a male connector that securely fits into a female connector disposed on the fluid applicator body 2; a slot or aperture that receives and/or forms a snug fit with the fluid applicator body 2, or a portion, e.g. a tapered portion, thereof; and any other suitable means.

Figure 10:
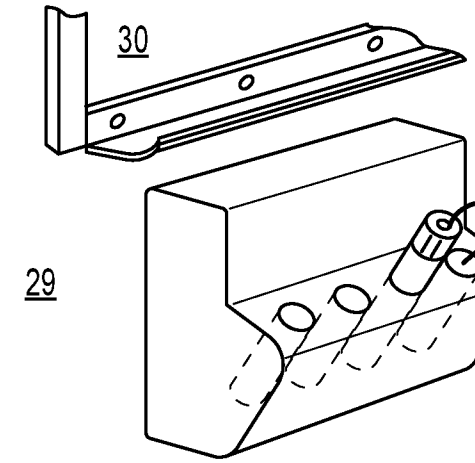
FIG. 10 is a perspective view of an embodiment of a multi-applicator refilling unit according to the present invention, mounted below a whiteboard.
Figure 11:
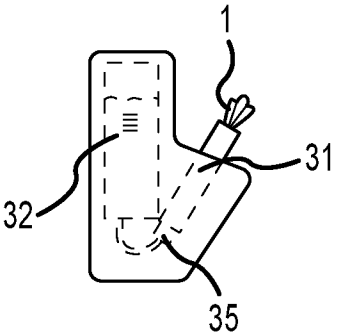
FIG. 11 is an end view of the multi-applicator refilling unit illustrated in FIG. 10, with hidden lines illustrating a fluid reservoir and refilling mechanism.
Figure 12:
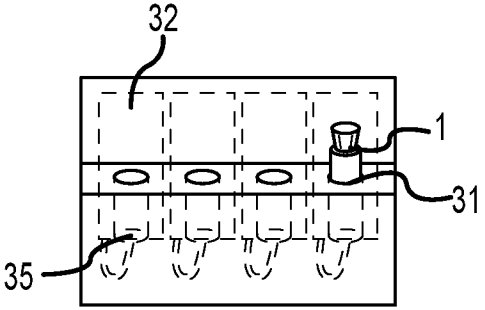
FIG. 12 is a front view of the multi-applicator refilling unit illustrated in FIG. 10, with hidden lines illustrating the fluid reservoirs and refilling mechanisms for each respective refillable fluid applicator receptacle.

Referring now to FIGS. 10-12, a first embodiment of a refilling unit according to the present invention is illustrated. The embodiment illustrated in FIGS. 10-12 is a multi-applicator refilling unit that can refill a plurality of refillable fluid applicators, such as the refillable fluid applicator illustrated in FIGS. 1-6, via receptacles 31. As illustrated in FIGS. 10-12, the refilling unit is mounted on an at least substantially flat surface 29 near a whiteboard 30, as one non-limiting example of a mounting location. The multi-applicator refilling unit comprises a plurality of replaceable fluid reservoirs 32 and replaceable refilling assemblies 35. This embodiment allows a variety of fluid applicators, such as but not limited to dry erase markers in a variety of marking colors, in one refilling unit.

Figure 13:
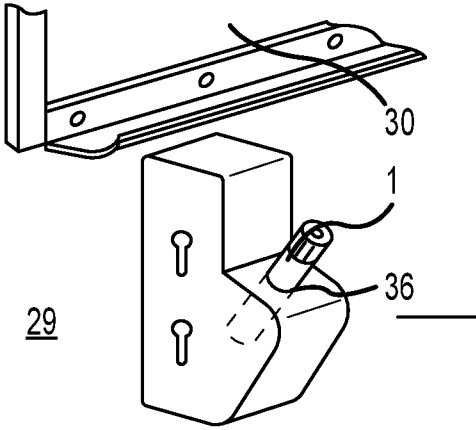
FIG. 13 is a perspective view of an embodiment of a single-applicator refilling unit according to the present invention, mounted below a whiteboard.
Figure 14:
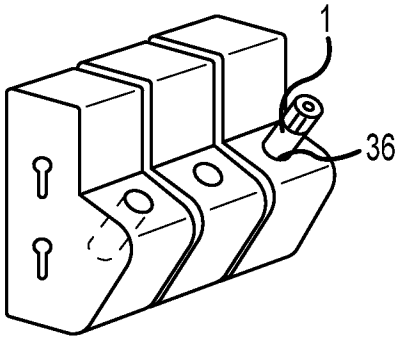
FIG. 14 is a perspective view of multiple single-applicator refilling units as illustrated in FIG. 13, affixed to one another.
Figure 15:
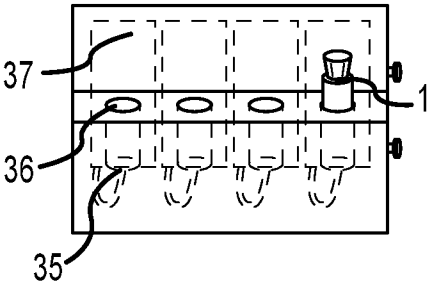
FIG. 15 is a front view of multiple single-applicator refilling units as illustrated in FIG. 13, affixed to one another, with hidden lines illustrating the fluid reservoirs and refilling mechanisms for each respective refillable fluid applicator receptacle.
Figure 16A:
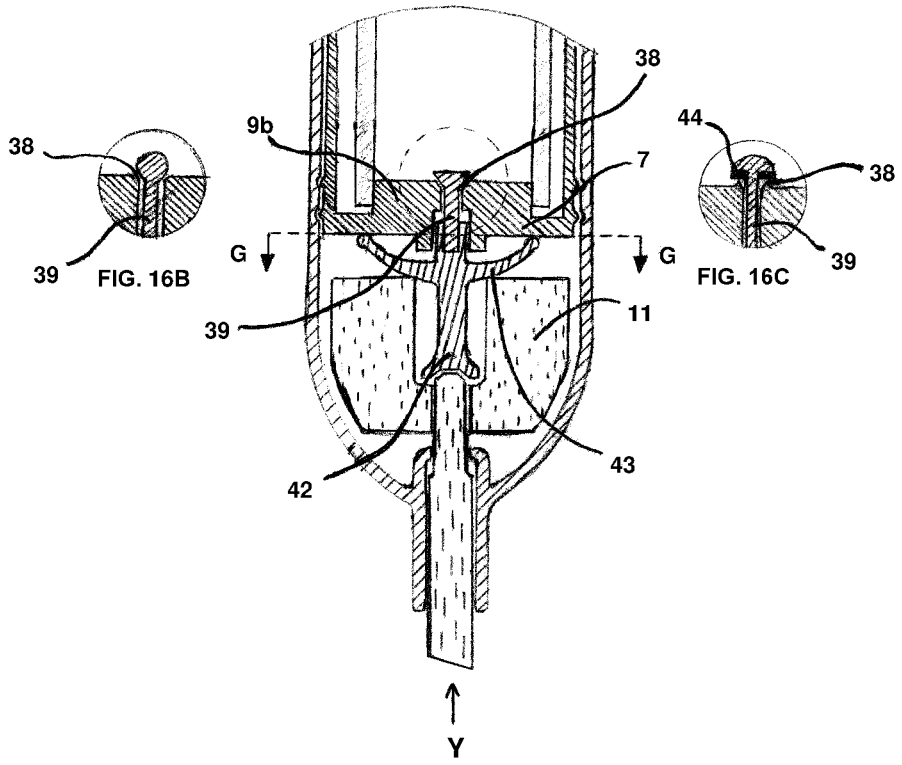
FIG. 16A is a longitudinal cross-section of a portion of an embodiment of a refillable fluid applicator according to the present invention, showing a valve and related elements.
Figure 17A:
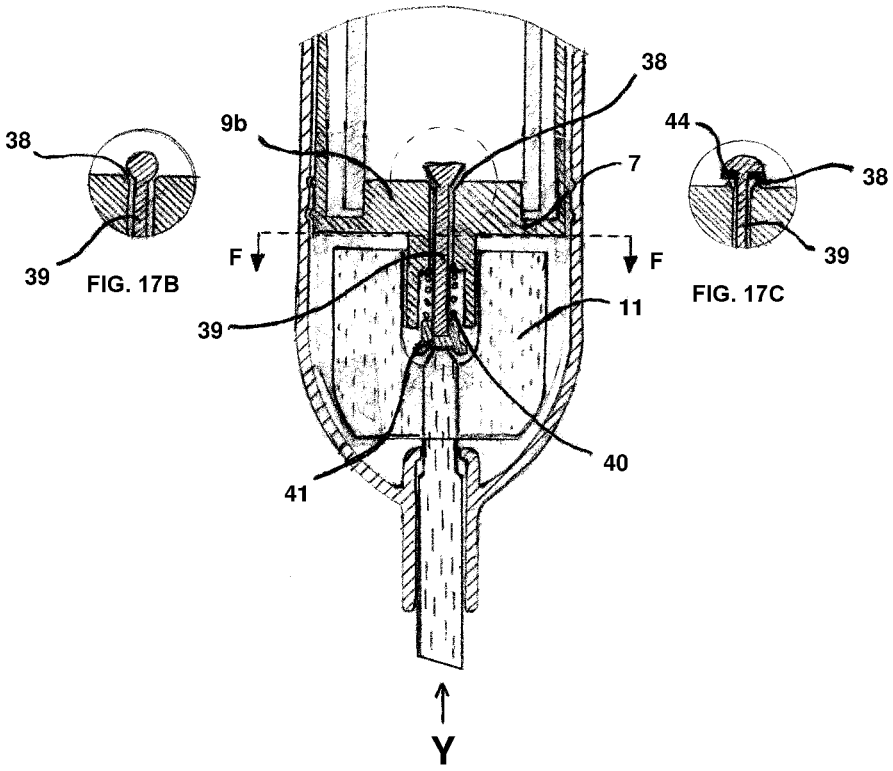
FIG. 17A is a longitudinal cross-section of a portion of an embodiment of a refillable fluid applicator according to the present invention, showing a valve and related elements.

Referring now to FIGS. 13-15, a second embodiment of a refilling unit according to the present invention is illustrated. The embodiment illustrated in FIGS. 13-15 is a single-applicator refilling unit, which may, but need not, be nested with, or interconnected, attached, affixed, or otherwise placed in close proximity to, identical or similar refilling units. The refilling unit illustrated in FIGS. 13-15 can refill a refillable fluid applicator, such as but not limited to the refillable fluid applicator illustrated in FIGS. 1-6, when the refillable fluid applicator is inserted in a receptacle 36. As illustrated in FIGS. 13-15, the refilling unit is mounted on an at least substantially flat surface 29 near a whiteboard 30, as one non-limiting example of a mounting location. The single-applicator unit comprises a replaceable fluid reservoir 37 and a replaceable refilling assembly 35. This design allows a user to "mix and match" varieties of fluid applicator, such as but not limited to dry erase markers in a variety of marking colors, by combining two or more single-applicator refilling units.

Figure 18:
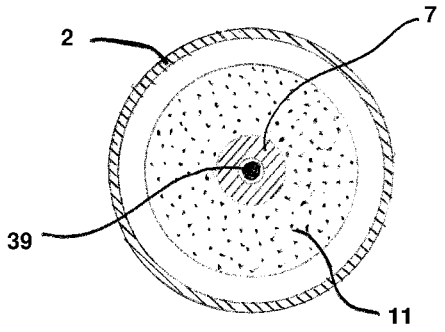
FIG. 18 is a cross-sectional view of the refillable fluid applicator illustrated in FIGS. 16A and 17A, taken at the line marked "F-F."
Figure 19:
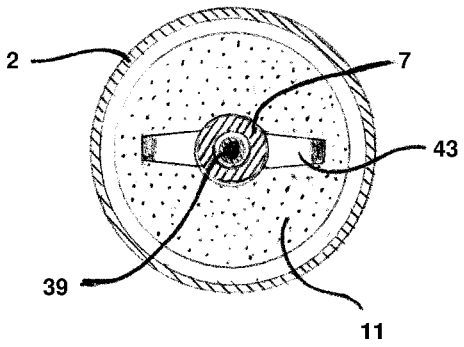
FIG. 19 is a cross-sectional view of the refillable fluid applicator illustrated in FIGS. 16A and 17A, taken at the line marked "G-G."

Referring now to FIGS. 16-19, an embodiment of a refillable fluid applicator according to the present invention is provided with a valve, which is attached to or integrated with the shaped union 9*b* such that the valve prevents fluid from entering or exiting the fluid cavity 15. The valve is sealed by a sealing surface 38, which has been illustrated as annular but may take any suitable shape and is met by another concentric feature to provide a tight seal against the fluid. As illustrated in FIGS. 16B, 16C, 17B, and 17C, a rounded feature on the end of a valve rod 39 may be provided to press against the sealing surface 38; in the embodiments illustrated in FIGS. 16B and 17B, this feature is spherical or ball-shaped. In FIGS. 16C and 17C, a rubber element 44 attached to the valve rod 39 presses against the sealing surface 38. The valve is held closed by either an integrated elastic element 43, as in In FIG. 17A, the valve rod 39 is attached to an applicator tip seat 41, while in FIG. 16A the valve rod 39 is attached to a combined applicator seat/spring feature 42, which is of unitary construction with integrated elastic element 43. Elastic elements 40, 43 are illustrated as springs, but may comprise any suitable elastic element for selectively opening and closing the valve. Cross-sections of this embodiment of the refillable fluid applicator at lines F-F and G-G are illustrated in FIGS. 18 and 19, respectively.

The valve illustrated in FIGS. 16A through 17C is opened with a force applied in the direction of the arrow marked "Y", which may be exerted when a user presses down on the applicator tip 12 to apply fluid to a surface. The force applied to the applicator tip 12 translates through the applicator tip 12 to the applicator tip seat 41 and/or combined applicator tip seat/spring feature 42, such that elastic elements 40, 43 are flexed and the valve opens. With the valve open, fluid in the fluid cavity 15 can flow through gaps around the valve rod 39, elastic elements 40, 43, and applicator tip seat 41 and/or combined applicator tip seat/spring feature 42 to the porous feature 11 and applicator tip 12.

While the foregoing description and the drawings generally depict the refillable fluid applicator of the present invention as a dry erase marker or similar writing instrument, it is to be expressly understood that the invention may be suitable for many other applications, and that such applications are within the scope of the present invention. By way of non-limiting example, the refillable fluid applicator may be a writing instrument other than a dry erase marker, such as a permanent marker, a highlighter, a security marker, an election marker, or a porous point pen such as a draftsperson's pen. The fluid applicator may also, by way of non-limiting example, comprise a device suitable for uses other than writing, such as a paint pen, a laundry detergent applicator, a correction fluid applicator, or an applicator for a cleaning or polishing fluid such as dish soap, hand soap, floor cleaner, or furniture polish.

The invention claimed is:

1. A fluid applicator refill system, comprising:

a refillable fluid applicator, comprising a first interface element, a fluid reservoir, and an applicator tip, wherein fluid in the fluid reservoir has a first pressure; and a refilling unit, comprising a primary fluid reservoir, at least one actuating member, a first valve, a second interface element, and at least one fluid communicating element, wherein fluid in the primary fluid reservoir has a second pressure, wherein the second pressure is higher than both an ambient atmospheric pressure and the first pressure, wherein the first and second interface elements are configured to generate an interface force when placed in physical contact with, or close proximity to, each other, wherein the at least one actuating member is configured, when acted upon by the interface force, to open the first valve and cause the at least one fluid communicating element to place the fluid reservoir of the refillable fluid applicator and the primary fluid reservoir in fluid communication, wherein, when the first valve is open, the fluid contained in the primary fluid reservoir flows out of the primary fluid reservoir, through the first valve and the at least one fluid communicating element, and into the fluid reservoir of the refillable fluid applicator, and wherein the first and second interface elements are magnetically attractive and the interface force comprises a magnetic force, wherein the magnetic force aligns and securely interconnects the refillable fluid applicator with the refilling unit.

2. The fluid applicator refill system of claim 1, wherein the refillable fluid applicator further comprises a second valve disposed between the fluid reservoir and the applicator tip, wherein the fluid reservoir and the applicator tip are in fluid communication when the second valve is open and not in fluid communication when the second valve is closed.

3. The fluid applicator refill system of claim 2, wherein the refillable fluid applicator further comprises an elastic element separate from the second valve, wherein the elastic element is configured to open the second valve when pressure is exerted on the applicator tip and to hold the second valve closed otherwise.

4. The fluid applicator refill system of claim 2, wherein the refillable fluid applicator further comprises an elastic element integrated with the second valve, wherein the elastic element is configured to open the second valve when pressure is exerted on the applicator tip and to hold the second valve closed otherwise.

5. The fluid applicator refill system of claim 1, wherein the refillable fluid applicator further comprises a porous element disposed between the fluid reservoir and the applicator tip.

6. The fluid applicator refill system of claim 1, wherein the refillable fluid applicator is a writing instrument.

7. The fluid applicator refill system of claim 5, wherein the porous element is disposed circumferentially about at least part of the applicator tip.

8. The fluid applicator refill system of claim 1, wherein the refillable fluid applicator includes a vent or opening for transfer of air between an exterior environment and a cavity of the refillable fluid applicator.

9. The fluid applicator refill system of claim 1, further comprising an applicator tip cap having a magnetically attractive element.

10. The fluid applicator refill system of claim 1, further comprising at least one septum associated with the fluid reservoir, wherein the at least one septum is configured to be penetrated by the at least one fluid communicating element of the refilling unit to allow flow of the fluid from the refilling unit into the fluid reservoir via the at least one fluid communicating element, and to form a substantially fluid-tight seal of the fluid reservoir when not penetrated by the at least one fluid communicating element.

* * * * *